United States Patent [19]

Bradford

[11] 4,067,120

[45] Jan. 10, 1978

[54] GRAIN DRYER WITH AIR RECYCLING DUCTS

[75] Inventor: John O. Bradford, Gibson City, Ill.

[73] Assignee: M & W Gear Company, Gibson City, Ill.

[21] Appl. No.: 710,545

[22] Filed: Aug. 2, 1976

[51] Int. Cl.[2] ..... F26B 17/12

[52] U.S. Cl. ..... 34/65; 34/169; 34/170; 34/212; 98/56

[58] Field of Search ..... 34/64, 65, 167–170, 34/174, 210, 212, 225, 224, 232; 98/32, 33 A, 52, 55, 56

[56] References Cited

U.S. PATENT DOCUMENTS

| | | | |
|---|---|---|---|
| 1,669,012 | 5/1928 | Nordstrom | 34/169 |
| 2,740,204 | 4/1956 | Seltzer et al. | 34/169 |
| 3,710,449 | 1/1973 | Rathbun | 34/170 |
| 4,006,536 | 2/1977 | Meiners | 34/169 |

*Primary Examiner*—Kenneth W. Sprague
*Assistant Examiner*—James C. Yeung
*Attorney, Agent, or Firm*—Allegretti, Newitt, Witcoff & McAndrews

[57] ABSTRACT

A concurrent-countercurrent air flow grain dryer of the type having an enclosed bin with a wet grain inlet at the top and a dry grain outlet at the bottom includes means for introducing hot air near the top of the bin to serve as a drying medium for the grain in a flow concurrent with the grain. Means are provided at the bottom of the bin to introduce cool air which flows countercurrent to the grain flow. An exhaust is provided intermediate where the hot and cool air are introduced. A manifold for the exhaust directs parts of the exhaust air through the hot air inlet portion of the dryer. In this manner, at least a portion of the exhaust air is recycled prior to ultimate exhaust from a vent associated with the exhaust manifold.

6 Claims, 2 Drawing Figures

GRAIN DRYER WITH AIR RECYCLING DUCTS

BACKGROUND OF THE INVENTION

This invention relates to an improved grain dryer and, more particularly, to an improvement in a concurrent-countercurrent flow type grain dryer of the type disclosed in U.S. Pat. No. 3,727,323, U.S. Pat. No. 3,302,297, U.S. Pat. No. 3,710,449, or U.S. Pat. No. 3,913,242, each of which is incorporated herewith by reference.

The above patents disclose, in general, a grain dryer wherein wet grain is introduced at the top of a bin for flow in a generally downward direction. Dried grain is withdrawn from the bottom of the bin simultaneous with the feeding of wet grain at the top of the bin. Heated air is introduced through hot air inlet ducts adjacent the top of the bin for flow in a direction which is concurrent with the grain flow. Simultaneously cool air is introduced adjacent the bottom of the bin near the grain discharge outlets for flow in a direction countercurrent to the direction of grain flow. Exhaust ducts are positioned intermediate the hot air inlet ducts and cold air inlet ducts for discharge to the atmosphere. Thus, the hot air will be somewhat reduced in temperature and moisture laden, thereby removing moisture from the grain within the dryer. The cool air will be somewhat heated relative to its initial inlet temperature and may also include an additional moisture content.

By such apparatus, improved grain drying results are observed. It has been noted, however, that the moisture content of discharged air is not at all times a saturated moisture content. Consequently, some energy losses are observed with a drying system of the type described in the previously identified patents. Energy loss is especially accentuated or increased as air is moved through the bin at faster rates and at relatively higher pressures. To improve the efficiency of the grain dryer of the concurrrent-countercurrent type, the subject matter of the present invention was developed.

SUMMARY OF THE INVENTION

In a principal aspect, the present invention comprises a grain dryer of the type having an enclosed bin with a wet grain inlet at the top and a dry grain outlet at the bottom. A plurality of spaced, horizontal hot fluid inlet ducts are provided for directing a fluid drying medium downwardly in a concurrent direction to a continuously moving bed of grain. Below the hot fluid inlets are a plurality of spaced horizontal cold fluid inlet ducts adjacent the bottom of the bin for directing a fluid cooling medium upwardly in a countercurrent direction to the flow of the same bed of grain. The cold fluid inlet ducts are spaced from one another to provide a plurality of grain discharge outlets and thereby insure continuous downward grain bed movement or flow as wet grain is added at the top of the bin through the wet grain inlet. Cooling fluid is provided from external the bin and is directed through a separate chamber into the cold fluid inlet ducts.

Intermediate the hot and cold inlet ducts is a set of horizontal exhaust ducts for receiving and exhausting the fluid introduced at the hot and cold fluid inlets. A manifold is provided over the exhaust outlets for directing exhaust air or fluid through a fluid heating chamber and then into the hot air inlet ducts. Thus, exhaust fluid having its origin in the cold inlet ducts and hot inlet ducts is cycled through the heating mechanism for the grain dryer. The system is not closed since exhaust from the system is provided by means of a vent for the manifold.

It is thus an object of the present invention to provide an improved and more efficient grain dryer of the concurrent-countercurrent, air flow, continuous grain flow type.

A further object of the present invention is to provide an improved concurrent-countercurrent air flow, continuous grain flow dryer wherein at least a portion of the exhaust from the dryer is recycled by reheating and redirecting it through the hot air inlet ducts.

Still another object of the present invention is to provide an improved concurrent-countercurrent, air flow, continuous grain flow dryer which utilizes structure of prior art grain dryer constructions modified to provide improved efficiency and results.

Another object of the present invention is to provide an improved concurrent-countercurrent air flow, continuous grain flow dryer wherein the hot air exhasut is, in part, vented to atmosphere and, in part, recycled through the heating ducts, and wherein the cold air exhaust is substantially totally recycled through the heating ducts.

These and other objects, advantages and features of the present invention will be set forth in greater detail below.

BRIEF DESCRIPTION OF THE DRAWING

In the detailed description which follows, reference will be made to the drawing comprised of the following figures.

DESCRIPTION OF THE PREFERRED EMBODIMENT

Figure 1:
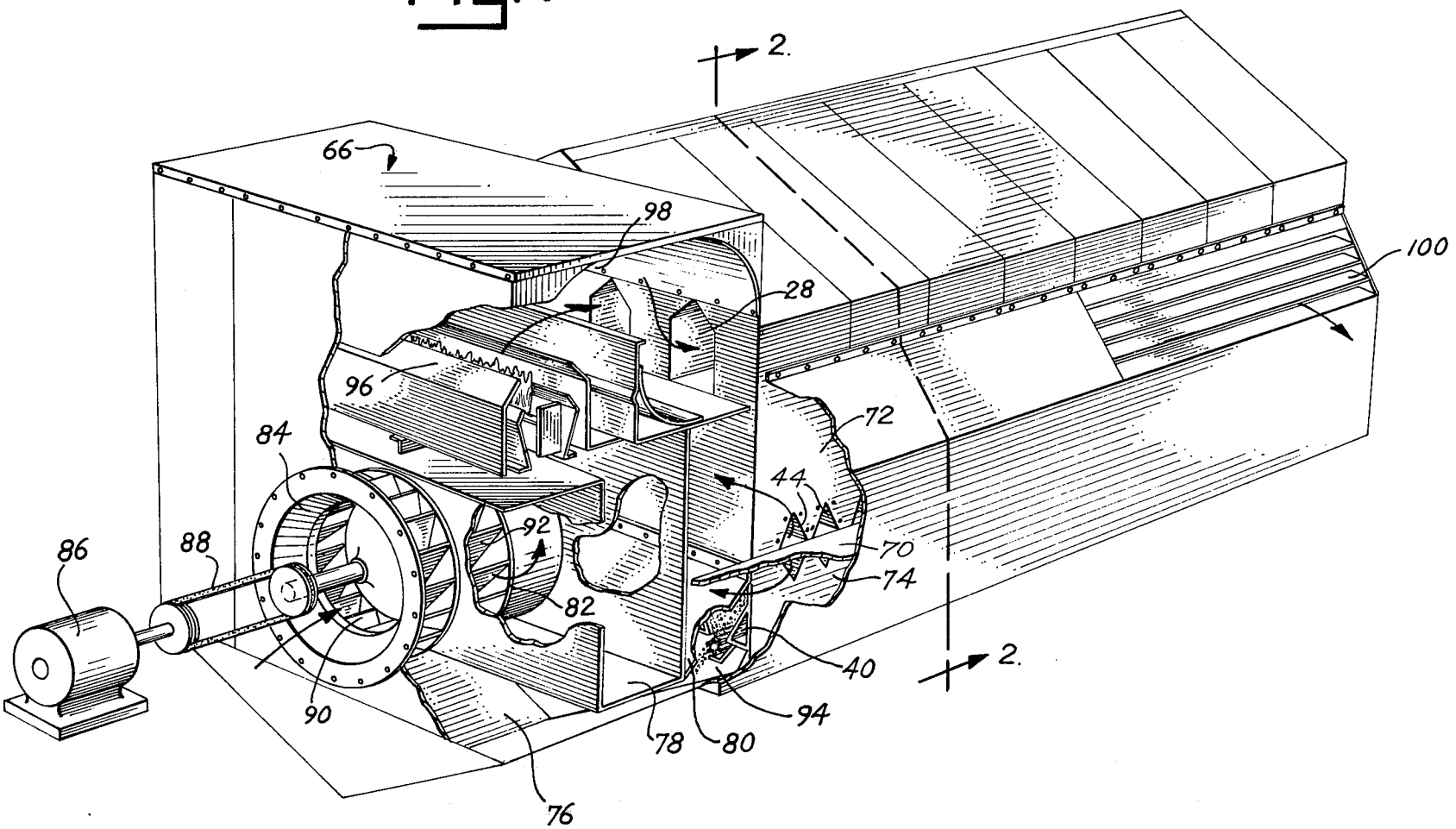
FIG. 1 is a cut-away, perspective view of the improved concurrent-countercurrent, fluid flow continuous grain flow dryer of the present invention.

The general operation of a concurrent-countercurrent, air flow, continuous grain flow type dryer is set forth in the various references identified above. These references are incorporated herewith by reference for their description of the operation of a concurrent-countercurrent type grain dryer.

Briefly, the basic operation of such a grain dryer can be understood by referring to the FIGURES. A bin 12 is defined by various walls including inclined top walls 14 and 16 and lateral side walls 18 and 20. A grain inlet auger 17 is provided adjacent the top of the bin for feeding grain into the bin 12.

Grain is held in the bin 12 by a floor generally defined by a plurality of horizontal cool air inlet ducts 40 adjacent the bottom of the bin 12. The ducts 40 are separated to define grain discharge passages 41. Thus, grain which feeds into the top of the bin 12 by means of the auger 17 is discharged through passages 41 for final removal by means of a discharge auger 50 is provided at the bottom of inclined sloping lower bin walls 46 and 48.

Heated air is introduced through horizontal inlet ducts 28. The heated air flows in a direction concurrent with grain flow and exhausts through transverse, horizontal exhaust ducts 44. Cool air enters through the cool air inlet ducts 40 which are formed from perforated metal. Cool air flows upwardly for exhaust through the exhaust ducts 44.

Thus, within the interior of the bin 12, generally hot air flows in the direction concurrent with the movement of the grain bed while generally cool air flows in the direction countercurrent to the movement of the grain bed. This particular structure and the relative movements of cool and hot air as well as the movement of the grain is unaltered by the structure of the present invention with respect to the prior art, except that air flows, are, in part, recycled. Thus, the present invention relates more particularly to the addition of manifolds 60 and 62 over outlets 64 associated with the opposite ends of the exhaust ducts 44. Also, the present invention includes additional improved structure associated with the air inlet means including an improved plenum assembly 66. The following description will therefore be directed in particular to the structure of the manifolds 60 and 62 as well as the plenum assembly 66.

Manifold 62 extends laterally along the entire side 20 of the bin 12. The manifold 62 encloses all of the outlets 64 associated with the side 20 so that exhaust air flowing to the outlets 64 may be collected by manifold 62 and appropriately directed. Each of the exhaust ducts 44 includes a dividing wall 68 which searates the duct 44 generally into two equal volume portions. The top portion receives exhaust hot air flowing in the concurrent direction. The bottom portion of duct 44 receives exhaust cool air flowing in the countercurrent direction. Of course, grain flow is unimpeded since the wall 68 is only provided within ducts 44. Wall 68 does not extend beyond the defined ducts 44 into the interior of the bin 12. The wall 68 is connected with a continuous separating wall 70 in the plenum 62 and 60. Thus, warm moist air is collected in an upper portion 72 of chambers 60 and 62. Cool air is collected in a lower portion 74 of chambers 60 and 62.

The plenum assembly 66 is comprised of three separate chambers. A first or forward chamber 76, a second or middle chamber 78 and a third or inner chamber 80. The second and third chambers 78, 80 are interconnected by means of a passage 82. The first chamber is connected to the atmosphere by means of a passage 84. A motor 86, through an appropriate pulley arrangement 88, operates concentrically mounted scroll fan units 90 and 92. Scroll fan unit 90 draws air from the atmosphere into the first chamber 76. The first chamber 76 is then connected by means of a passage 94 to the cool air inlet ducts 40.

The second scroll fan unit 92 draws air from the third chamber 80 into the second chamber 78. The third chamber 80 is connected directly with the upper portion 72 and lower portion 74 of the manifolds 60 and 62. Thus, the air from the exhaust ducts 44 passes into the third chamber 80, thence into the second chamber 78 where the fan unit 92 directs the air over a burner or heating unit 96 positioned in the second chamber 78. The air is then heated and flows by way of a passage 98 defined in the assembly 66 into the hot air inlet ducts 28. In this manner, air is recycled through the dryer.

Figure 2:
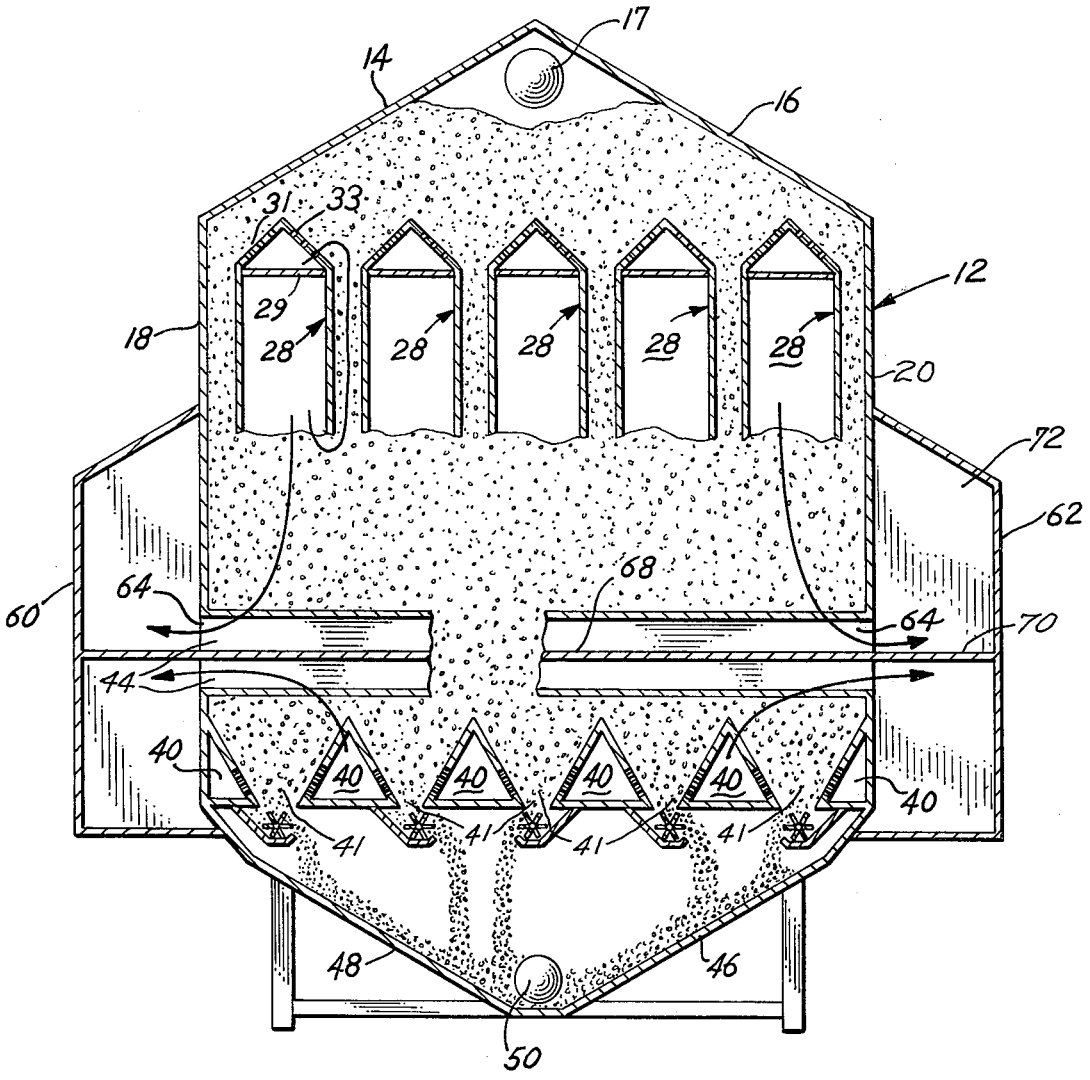
FIG. 2 is a cross-sectional view of the improved grain dryer of the present invention taken along the line 2—2 in FIG. 1.

Note that the hot air inlet ducts 28 may include a preheat construction of the type disclosed in U.S. Pat. No. 3,913,242. That is, a wall 29 in FIG. 2 may be provided near the top of a duct 28. Inclined top walls 31 and 33 of duct 28 may then be perforated to define a passage connected to atmosphere at one end of the bin in the same manner as disclosed in U.S. Pat. No. 3,913,242.

A vent 100 is provided in the manifolds 60 and 62 for exhaust of part of the air discharged through the upper portion 72 of the manifolds 60 and 62. Thus, moisture laden heated air will pass through the vent 100 as cool air enters the dryer via fan unit 90.

In operation then, cool air is drawn in through the front fan 90 and is blown into the cool air ducts 40. Dry warm air is directed into ducts 28. The rear intake scroll fan unit 92 pulls the exhaust air from ducts 44 into the second chamber 78 from the third chamber 80 and manifolds 60, 62. The air from manifolds 60, 62 is a mixture of partially saturated or saturated warm air from the concurrent flow into exhaust ducts 44 and cool air from the countercurrent flow into exhaust ducts 44. This mixture is directed past the burner 96 for further heating. The heated dry air is then blown into the hot air ducts 28 and distributed throughout the drying section, i.e., that section of the dryer generally above the exhaust ducts 44. Excess warm wet air from the drying section is exhausted or vented through ducts 44 and vent 100. Note that the vent 100 is positioned toward the opposite end of the bin 12 from the assembly 66. This insures more efficient operation of the improved dryer of the present invention.

With the improved structure of the present invention, it is possible to improve the efficiency of the dryer and remove more moisture per unit of energy input to the dryer. The following example is given:

| | Prior Art | New Device |
|---|---|---|
| Moisture Removal-points/ Hour | 7 | 7 |
| Capacity, Bushel per Hour | 550 | 900 |
| Gas Required-Cubic Feet per Hour | 2983 | 3606 |
| Specific Gas Consumption-Cubic Feet per Bushel | 5.42 | 3.95 |

Thus, while in the foregoing there has been set forth a preferred embodiment of the invention, it is to be understood that the invention shall be limited only by the following claims and their equivalents.

What is claimed is:

1. In a continuous flow, grain dryer of the type having an enclosed bin with a wet grain inlet at the top of said bin and grain outlets at the bottom of said bin including a plurality of spaced, parallel horizontal hot fluid inlet ducts for directing a fluid drying medium downwardly through a bed of grain in said bin, a plurality of spaced, parallel, horizontal cold fluid inlet ducts for directing a fluid cooling medium upwardly through said bed of grain, said cold fluid inlet ducts positioned parallel to and below said hot fluid inlet ducts and spaced from one another to provide a plurality of grain discharge outlets from said bin, fluid inlet means at one end of said inlet ducts, means for adding wet grain through said wet grain inlet, means for withdrawing dry grain from said grain outlets, horizontal exhaust duct means intermediate said hot and cold fluid inlet ducts and transverse thereto to receive and exhaust fluid medium flowing from said hot inlet ducts in a concurrent direction to grain flow and also exhaust cold fluid medium flowing from said cold inlet ducts in a countercurrent direction to grain flow, each of said exhaust duct means having outlets through said bin on opposite sides thereof, the region of the bin generally above the exhaust ducts defining a drying section of the bin, and the region of the bin generally below the exhaust ducts defining a cooling section of the bin, and means for providing hot fluid to said hot inlet duct inlets and cold fluid to said cold inlet duct inlets, the improvement comprising:

fluid plenum means including means for directing external cold fluid medium into the cold fluid inlet ducts, manifold means for recycling a portion of fluid from the exhaust duct means and for exhausting the remainder to the outside of the dryer, said manifold means for recycling comprising means for collecting the fluid portion from the exhaust duct means and means for directing all the collected fluid portion through the means for providing hot fluid to the hot fluid inlet ducts, said manifold means including an exhaust vent for exhausting the remainder of the exhaust fluid to the outside of the dryer.

2. The improvement of claim 1 wherein said fluid plenum means and said means for directing fluid to the hot fluid inlet ducts is at one end of the bin and the exhaust vent is adjacent the opposite end of the bin.

3. The improvement of claim 1 wherein said plenum means and manifold means includes: a plenum assembly having three separate chambers, one of said chambers being connected by a first passage to an external fluid source, a fluid propulsion unit for driving fluid from the external source through the first passage to the cold fluid inlet ducts; a second chamber with fluid heating means therein and connected to the third chamber by a second passage, said third chamber connected to the means for collecting from the dryer exhaust duct outlet means; a second fluid propulsion unit for withdrawing fluid from the third chamber through the second passage into the second chamber, thence past the fluid heating means, said second chamber including a discharge passage to the hot fluid inlet ducts.

4. The improvement of claim 3 wherein said fluid propulsion units comprise scroll fan units driven on a single shaft concentric with the first and second passages.

5. The improvement of claim 1 wherein said means for collecting is separated into an upper section for receipt of fluid from the drying section of the bin, the exhaust vent being provided only for the upper section, and a lower section for receipt of fluid from the cooling section of the bin.

6. The improvement of claim 1 wherein said means for collecting is separated into an upper section and a lower section for receipt resptively of fluid from the drying section and cooling section of the dryer, the exhaust vent being connected to the upper section.

* * * * *